US012222185B1

(12) United States Patent
Myer

(10) Patent No.: US 12,222,185 B1
(45) Date of Patent: Feb. 11, 2025

(54) REVERSE PRESSURE GRIP FOR FIREARMS

(71) Applicant: Wayne Myer, Clinton, NJ (US)

(72) Inventor: Wayne Myer, Clinton, NJ (US)

( * ) Notice: Subject to any disclaimer, the term of this patent is extended or adjusted under 35 U.S.C. 154(b) by 0 days.

(21) Appl. No.: 18/234,459

(22) Filed: Aug. 16, 2023

(51) Int. Cl.
*F41C 23/10* (2006.01)
*F41C 23/16* (2006.01)
*F41C 27/22* (2006.01)

(52) U.S. Cl.
CPC ..... *F41C 23/10* (2013.01); *F41C 23/16* (2013.01); *F41C 27/22* (2013.01)

(58) Field of Classification Search
CPC ..... F41C 23/00; F41C 23/06; F41C 23/08; F41C 23/10; F41C 23/12; F41C 23/16; F41C 27/00; F41C 27/22; F41C 33/08; F41C 3/00; F41A 17/20; F41A 17/22; F41A 17/24; F41A 17/26; F41A 17/28; F41A 19/34; F41A 33/00
See application file for complete search history.

(56) References Cited

U.S. PATENT DOCUMENTS 552,334 A * 12/1895 Sanger ..... F41C 23/08 42/74
1,042,132 A * 10/1912 Long ..... F41C 23/08 42/74
1,395,455 A * 11/1921 Searle ..... F41A 21/488 89/196
1,494,407 A * 5/1924 Beach ..... F41A 33/00 42/106
2,182,693 A * 12/1939 Harton ..... F41A 17/20 42/70.01
2,433,309 A * 12/1947 Van Karner ..... F41C 7/11 124/31
2,669,050 A * 2/1954 Quick ..... F41A 17/26 42/70.08
2,874,502 A * 2/1959 Lockwood ..... F41A 19/10 42/69.01
4,132,023 A * 1/1979 Weldle ..... F41A 19/34 89/138
4,630,387 A * 12/1986 Crane ..... F41C 23/10 42/71.02
4,757,627 A * 7/1988 Saligari ..... A22B 3/02 42/36
5,375,360 A * 12/1994 Vatterott ..... F41C 23/08 42/74
5,517,780 A * 5/1996 Haber ..... F41A 17/20 42/70.08
5,857,279 A * 1/1999 de Oliveira Masina ..... F41C 23/10 42/74
6,405,468 B1 * 6/2002 Gilgenbach ..... F41A 17/46 42/70.01

(Continued)

*Primary Examiner* — Gabriel J. Klein
(74) *Attorney, Agent, or Firm* — Thomas J. Germinario

(57) ABSTRACT

In a firearm gun grip, the rigid front force of the gun grip is replaced with a sliding grip panel, which inserts into a conjugate panel recess in the gun grip. The panel recess contains multiple coiled compression springs, which extend between the interior forward end of the grip panel and the rear surface of the panel recess. The compression of the springs, under the inward constrictive force of a shooter's hand on the gun grip, produces an opposing outward expansive force, which changes in response to the degree of insertion of the grip panel into the panel recess, thereby serving to stabilize the gun grip and improve aiming accuracy.

10 Claims, 7 Drawing Sheets

(56) References Cited

U.S. PATENT DOCUMENTS

| | | | | |
|---|---|---|---|---|
| 6,442,880 | B1 * | 9/2002 | Allan | F41A 17/066 42/70.11 |
| D560,750 | S * | 1/2008 | Potter | F41C 23/10 D22/108 |
| 7,685,755 | B1 * | 3/2010 | Bentley | F41G 11/003 42/1.06 |
| 7,770,318 | B2 * | 8/2010 | Bentley | F41C 23/16 42/74 |
| 8,201,354 | B2 * | 6/2012 | Bentley | F41C 23/16 42/74 |
| 9,909,830 | B1 * | 3/2018 | Toole | F41G 1/35 |
| 10,775,125 | B1 * | 9/2020 | Owen, Jr. | F41A 33/00 |
| 11,243,035 | B1 * | 2/2022 | Zung | F41A 17/52 |
| 11,698,236 | B2 * | 7/2023 | Zung | F41A 17/22 42/70.11 |
| 2002/0170224 | A1 * | 11/2002 | Lawless | F41C 23/10 42/71.02 |
| 2004/0049963 | A1 | 3/2004 | Christiansen | |
| 2010/0212203 | A1 | 8/2010 | McGarry | |
| 2010/0275483 | A1 | 11/2010 | Bentley | |
| 2011/0258900 | A1 | 10/2011 | Sims et al. | |
| 2012/0222342 | A1 * | 9/2012 | Chvala | F41C 23/04 42/74 |
| 2014/0250755 | A1 | 9/2014 | Hogue | |
| 2018/0372443 | A1 | 12/2018 | Lyman | |
| 2021/0025670 | A1 | 1/2021 | Miller | |
| 2022/0120525 | A1 * | 4/2022 | Zung | F41A 17/52 |

* cited by examiner

REVERSE PRESSURE GRIP FOR FIREARMS

FIELD OF INVENTION

The present invention relates generally to the field of firearm grips, and more specifically to firearm grips containing spring mechanisms.

BACKGROUND OF THE INVENTION

In maintaining the aiming stability of a firearm, it is important to balance the opposing forces of the shooter's hand squeezing the gun grip and the reactive force of the grip back against the hand. The stronger and more uniform the shooter's grip, the more sustained is the balance of forces through the firing cycle, thereby providing greater stability of the firearm and optimal aiming accuracy.

Conventional firearm grips, however, are too rigid to allow for much of a range in the maximum reactive force they can apply against a shooter's grip, so that it's difficult to achieve a sustained balance of forces for shooters having different grip strengths. The present invention addresses this shortcoming by providing an adjustable reactive force supplied by multiple steel coil compressive springs in a sliding panel of the gun grip.

SUMMARY OF THE INVENTION

In the present invention, the rigid front face of the gun grip is replaced with a sliding grip panel, which inserts into a conjugate panel recess in the gun grip. The panel recess contains multiple coiled compression springs, which extend between the interior forward end of the grip panel and the rear surface of the panel recess. The compression of the springs, under the inward constrictive force of a shooter's hand on the gun grip, produces an opposing outward expansive force, which changes in response to the degree of insertion of the grip panel into the panel recess. The relationship between the width of the grip panel insertion "x" and the springs' reactive force "F" is given by Hooke's Law as follows:

$$F=Kx$$

where K is the sum total of the spring constants of the multiple compression springs.

For example, if the sliding grip panel's insertion width is 15 millimeters, and there are three compression springs, each having a spring constant K of 8 Newtons/millimeter, the balancing reactive force exerted upon the grip panel by the springs would be:

$$F=Kx=15\text{ mm}\times 24\text{ N/mm}=360\text{ N}=81\text{ lbs. force}$$

Since typical shooter's grip forces fall in the range of 40-80 lbs. (178-356 N), a three-spring version of the present invention's reverse pressure mechanism, having a grip panel insertion width in the range of 5-15 mm (0.2-0.6 in.), would require a total spring constant K in the range:

$$K_{min}=F/x=178\text{ N}/15\text{ mm}=12\text{ N/mm}$$

$$K_{max}=F/x=356\text{ N}/15\text{ mm}=24\text{ N/mm}$$

so that the range of individual spring constants would be 4-8 N/mm.

In one embodiment of the present invention, the outward expansive force exerted by the compression springs is adjustable by removing or adding to the number of springs or substituting springs with higher or lower spring constants.

In order to maintain the proper balance of forces on the grip panel, it's important that the reactive force of the compression springs be uniform across the length of the grip panel. This requires a uniform spring constant for all springs and uniform spring spacing on the rear surface of the panel recess. In order to insure uniformity in the shooter's constricting force on the gun grip, the outer surface of the grip panel preferably has indentations for proper positioning of the shooter's fingers.

Since the reverse pressure grip enables a stabilizing balance of forces on the gun grip with less constricting force from the shooter's hand, the shooter will experience less grip fatigue and will consequently be able to maintain aiming accuracy over a longer time period. Also, the reverse pressure grip allows shooters having below average grip strength to still maintain aiming stability using less force than would be required by conventional grips.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1A:
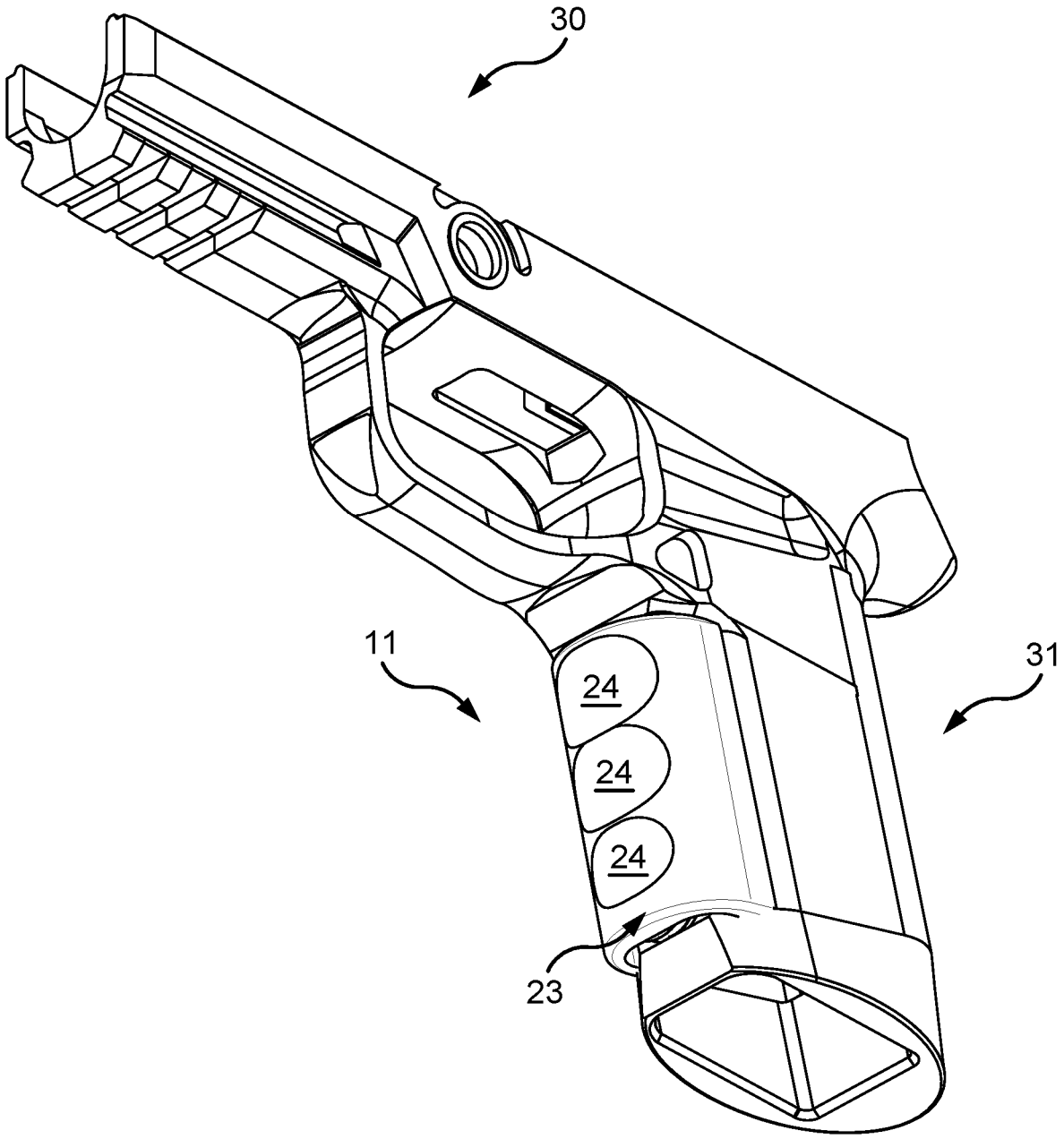
FIG. 1A is a perspective view of a gun grip frame having a gun grip incorporating an embodiment of the present invention.

Referring the Figures, they depict a standard P320 handgun grip frame 30, having a gun grip 31 that has been modified in accordance with reverse pressure mechanism 10 of the present invention. As best seen in FIG. 2B, oblong grip panel 11 has a generally arcuate-rectangular lateral cross section, with a generally arcuate closed front panel end 12 and a generally rectangular open inner panel end 13. The inner panel end 13 is configured to insert, along a sliding rail mechanism 25, through an insertion width 20 into a conjugate panel recess 14 in the gun grip 31.

Figure 2A:
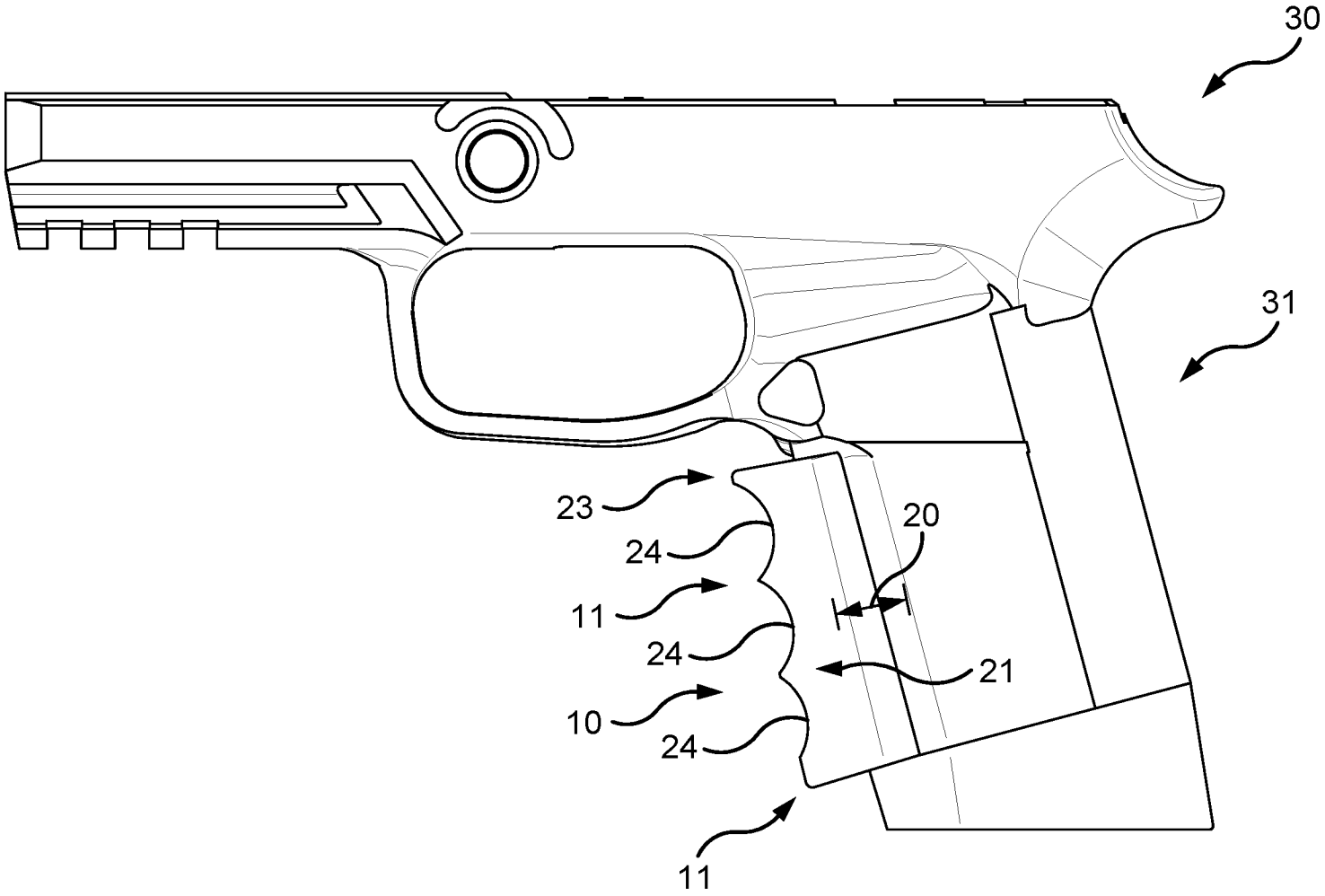
FIG. 2A is a side profile view of a gun grip frame having a gun grip incorporating an embodiment of the present invention.
Figure 2B:
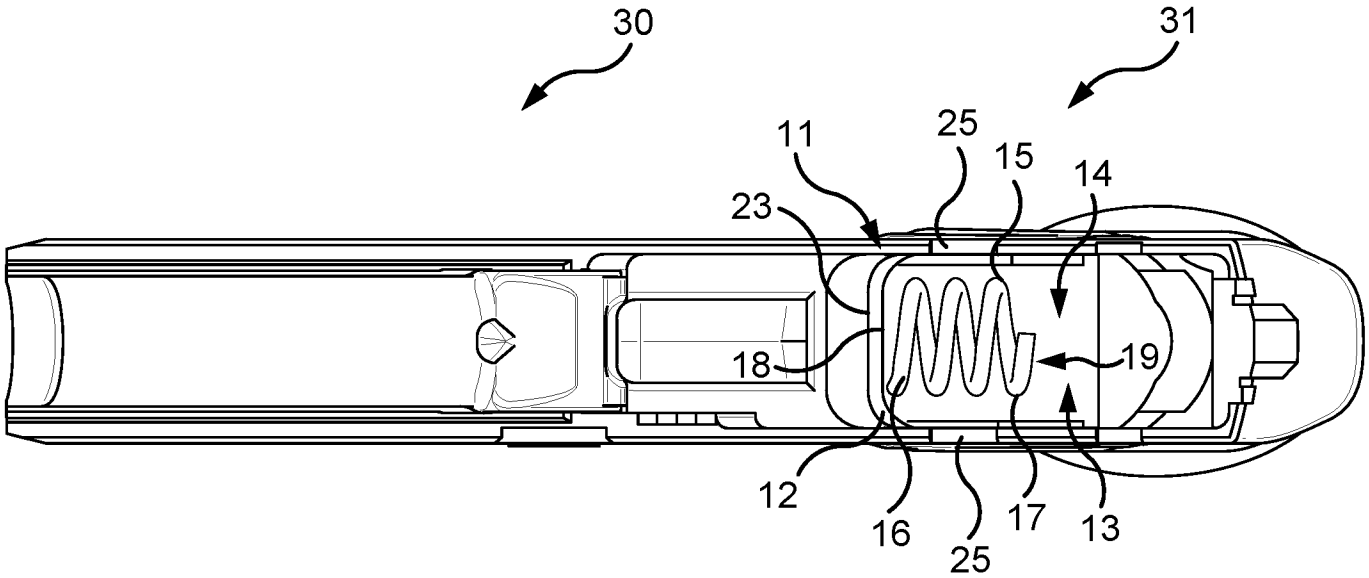
FIG. 2B is a top plan view of a gun grip frame having a gun grip incorporating an embodiment of the present invention.
Figure 2C:
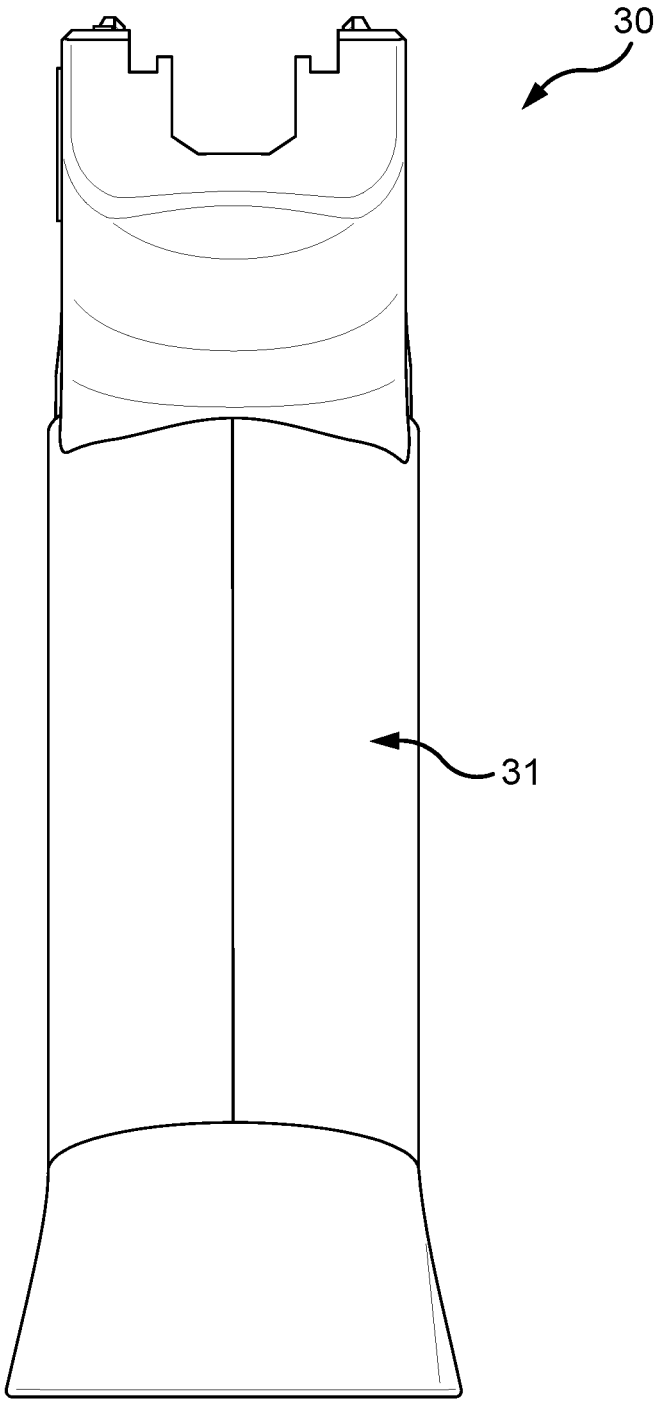
FIG. 2C is a rear profile view of a gun grip frame having a gun grip incorporating an embodiment of the present invention.
Figure 3A:
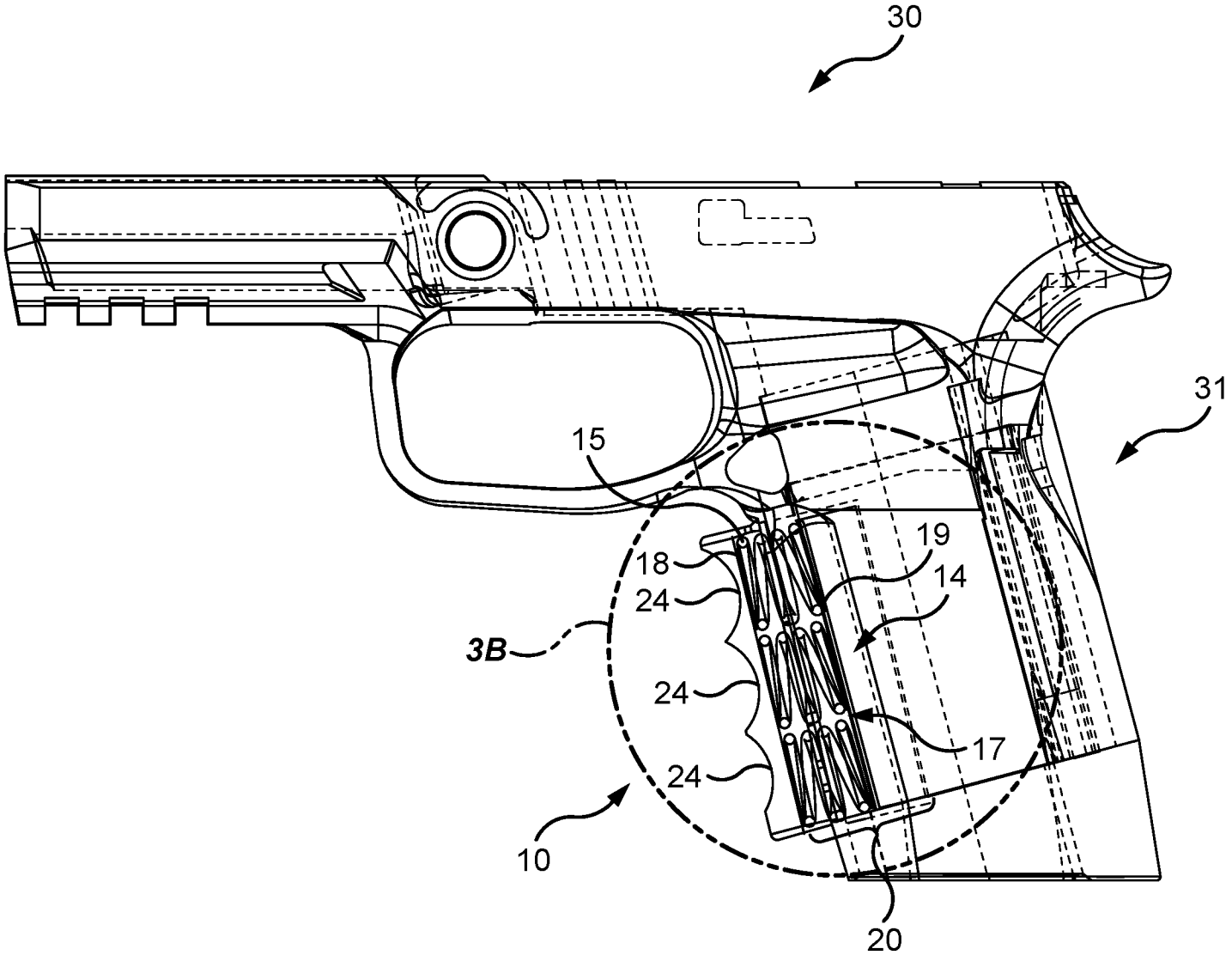
FIG. 3A is a side cut-away view of a gun grip frame having a gun grip incorporating an embodiment of the present invention.
Figure 3B:
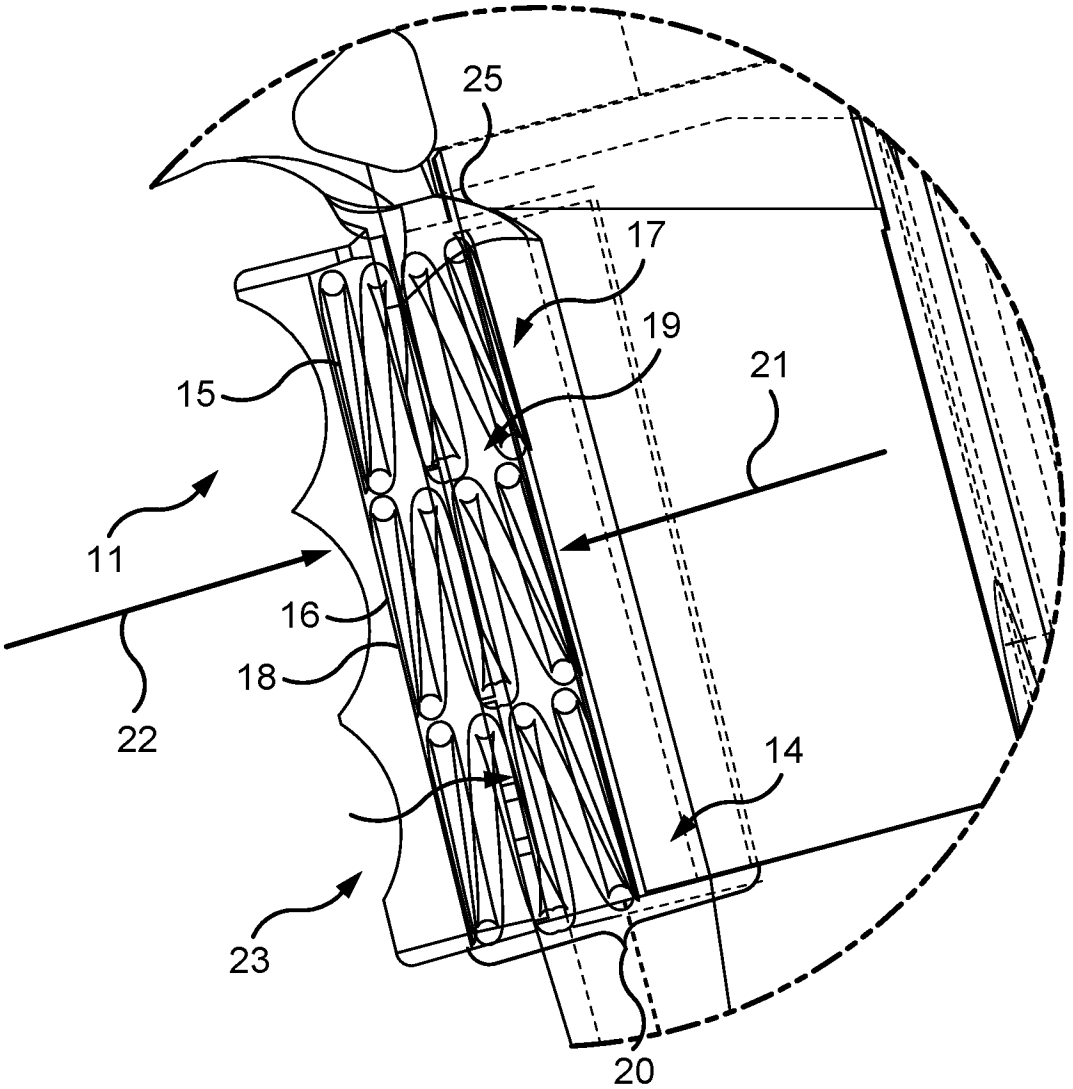
FIG. 3B is a detail view of the area enclosed by circle "A" in FIG. 3A.

Multiple steel coiled compression springs 15 (three in this embodiment) within the panel recess 14 are configured to resist the sliding insertion of the grip panel 11 into the panel recess 14 through the insertion width 20 (best seen in FIGS. 2A and 3B). The proximal end 16 of each compression spring 15 engages the interior surface 18 of the forward panel end 12, while the distal end 17 of each spring 15 engages the rear inner surface 19 of the panel recess 14. This configuration caused the springs 15 to compress when an inward constricting force 22 is applied to the forward panel end 12 of the grip panel 11, such that the compressed springs 15 (best seen in FIGS. 3A and 3B) exert an outward expansion force 21 which balances the inward constricting force 22, thereby stabilizing the gun grip 31 with less gripping force 22 than would otherwise be required.

Figure 1B:
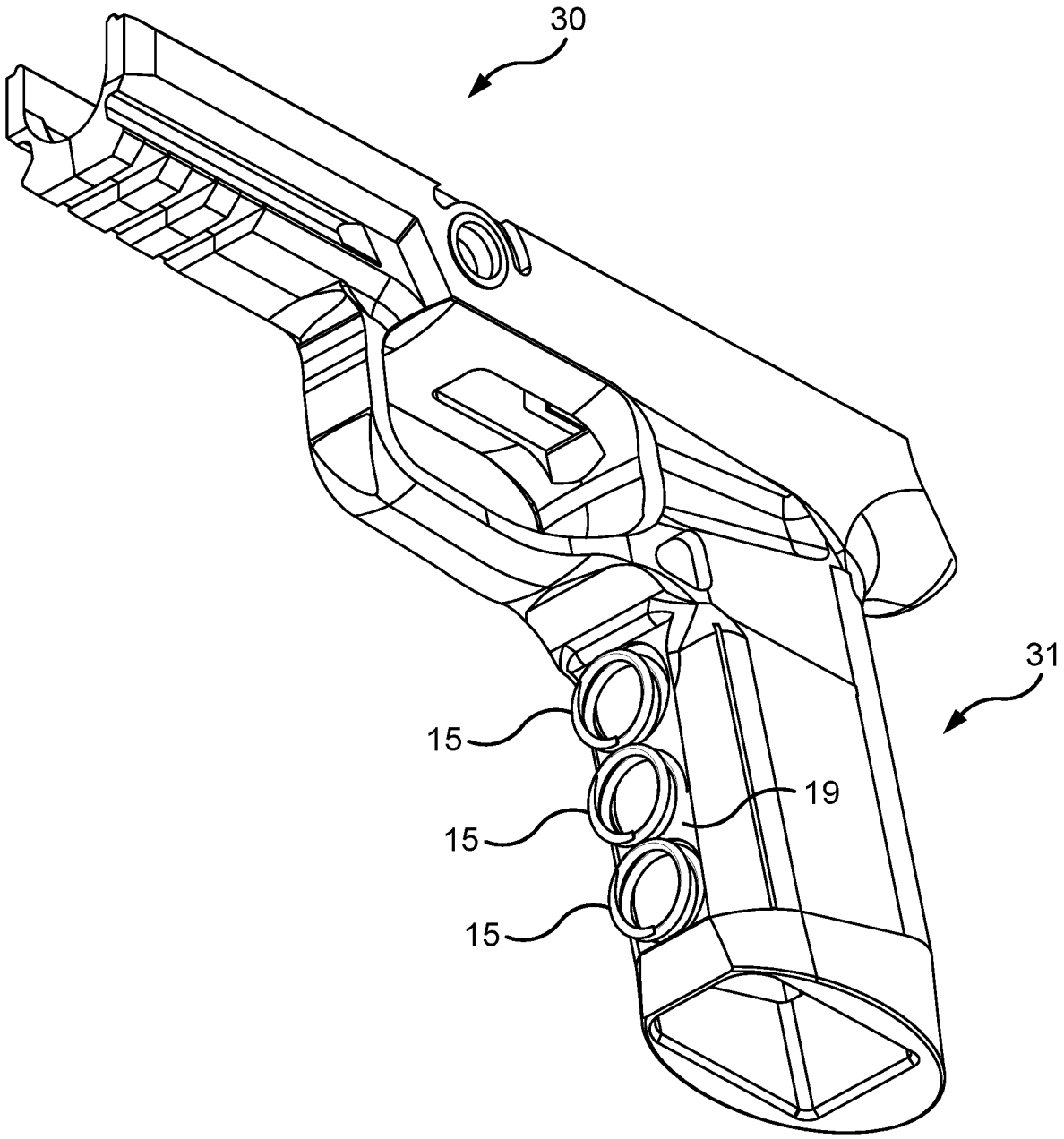
FIG. 1B is the perspective view of a gun grip frame having a gun grip incorporating an embodiment of the present invention, with the grip panel removed to expose the compression springs.

As best seen in FIGS. 1B and 3B, the compression springs 15 are uniformly spaced along the rear inner surface 19 of the panel recess 14, so as to provide a uniform outward expansive force 21. In order to promote a balancing uniformity of the inward constricting force 22, finger grip indentations 24 are provided on the exterior surface 23 of the front panel end 12 of the grip panel 11.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A reverse pressure mechanism for a gun grip of a firearm, comprising:

an oblong grip panel, having a arcuate-rectangular lateral cross section, with a arcuate closed forward panel end and a rectangular open inner panel end, wherein the grip panel forms no part of a cocking mechanism of the firearm, and wherein the inner panel end is adapted to slide through an insertion width into a conjugate panel recess in the gun grip;

multiple coiled compression springs, each having a proximal end, which engages an interior surface of the forward panel end of the grip panel, and a distal end, which engages a rear inner surface of the panel recess in the gun grip, wherein the compression springs are adapted to compress so as exert a outward expansive force against an inward constricting force exerted on the forward panel end of the grip panel, and so as to resist insertion of the inner panel end into the panel recess in the gun grip, thereby imparting to the gun grip a stabilizing balance of forces between the outward expansive force of the compression springs and the inward constricting force exerted on the forward panel end of the gun grip, and thereby reducing the inward constricting force required for stable aiming of the firearm.

2. The reverse pressure mechanism according to claim 1, wherein the compression springs are configured so that the outward expansive force is uniform across the forward panel end of the grip panel.

3. The reverse pressure mechanism according to claim 2, wherein the outward expansive force exerted by the compression springs is adjustable by changing a number of the compression springs and/or by changing a total spring constant of the compression springs.

4. The reverse pressure mechanism according to claim 3, wherein the insertion width of the inner panel end of the grip panel into the panel recess in the gun grip is in the range of 5 to 15 millimeters.

5. The reverse pressure mechanism according to claim 4, wherein the total spring constant of the compression springs is in the range of 12 to 24 newtons per millimeter.

6. The reverse pressure mechanism according to claim 1, wherein an exterior surface of the forward panel end of the grip panel has two or more indentations that serve as finger grips.

7. The reverse pressure mechanism according to claim 2, wherein an exterior surface of the forward panel end of the grip panel has two or more indentations that serve as finger grips.

8. The reverse pressure mechanism according to claim 3, wherein an exterior surface of the forward panel end of the grip panel has two or more indentations that serve as finger grips.

9. The reverse pressure mechanism according to claim 4, wherein an exterior surface of the forward panel end of the grip panel has two or more indentations that serve as finger grips.

10. The reverse pressure mechanism according to claim 5, wherein an exterior surface of the forward panel end of the grip panel has two or more indentations that serve as finger grips.

* * * * *